United States Patent [19]

Metcalfe et al.

[11] 3,978,692

[45] Sept. 7, 1976

[54] CARPET PRINTING APPARATUS

[75] Inventors: Trevor Hatfield Metcalfe; Geoffrey Scott, both of Bradford; Paul Michael Thompson, Pudsey, near Leeds; Ernest Wilford, Crossflats, near Keighley, all of England

[73] Assignee: Associated Weavers Limited, Bradford, England

[22] Filed: Mar. 27, 1974

[21] Appl. No.: 455,432

[30] Foreign Application Priority Data

Mar. 30, 1973 United Kingdom ..... 15586/73

[52] U.S. Cl. ..... 68/5 D; 26/2 R; 68/181 R

[51] Int. Cl.[2] ..... D06B 3/22; D06B 21/00

[58] Field of Search ..... 26/2 R; 28/72 P, 74 P, 28/76 P; 68/5 D, 5 E, 9, 13 R, 181 R, 20, DIG. 5

[56] References Cited

UNITED STATES PATENTS

| | | | |
|---|---|---|---|
| 1,990,907 | 2/1935 | Kellogg | 68/13 R X |
| 2,443,990 | 6/1948 | O'Keeffe | 68/5 E |
| 2,785,042 | 3/1957 | Grajeck et al. | 26/2 R X |
| 3,503,134 | 3/1970 | Fleissner | 68/DIG. 5 |
| 3,503,231 | 3/1970 | Fleissner et al. | 68/5 E |
| 3,739,436 | 6/1973 | Naujoks et al. | 28/76 P X |
| 3,852,980 | 12/1974 | Zimmer | 68/5 D |

OTHER PUBLICATIONS

Beloit–Kleinenefers Textile Machinery Corp., "Carpet Finishing Ranges," Oct. 23, 1969.

*Primary Examiner*—Philip R. Coe
*Attorney, Agent, or Firm*—Pollock, Vande Sande & Priddy

[57] ABSTRACT

A method of printing carpets comprising printing the carpet and subsequently setting the printed colored dye on the pile of the carpet in a steamer, characterized in that the carpet is led from the steam on its back and in that its pile is subjected to an air flow before the carpet enters a washer.

5 Claims, 1 Drawing Figure

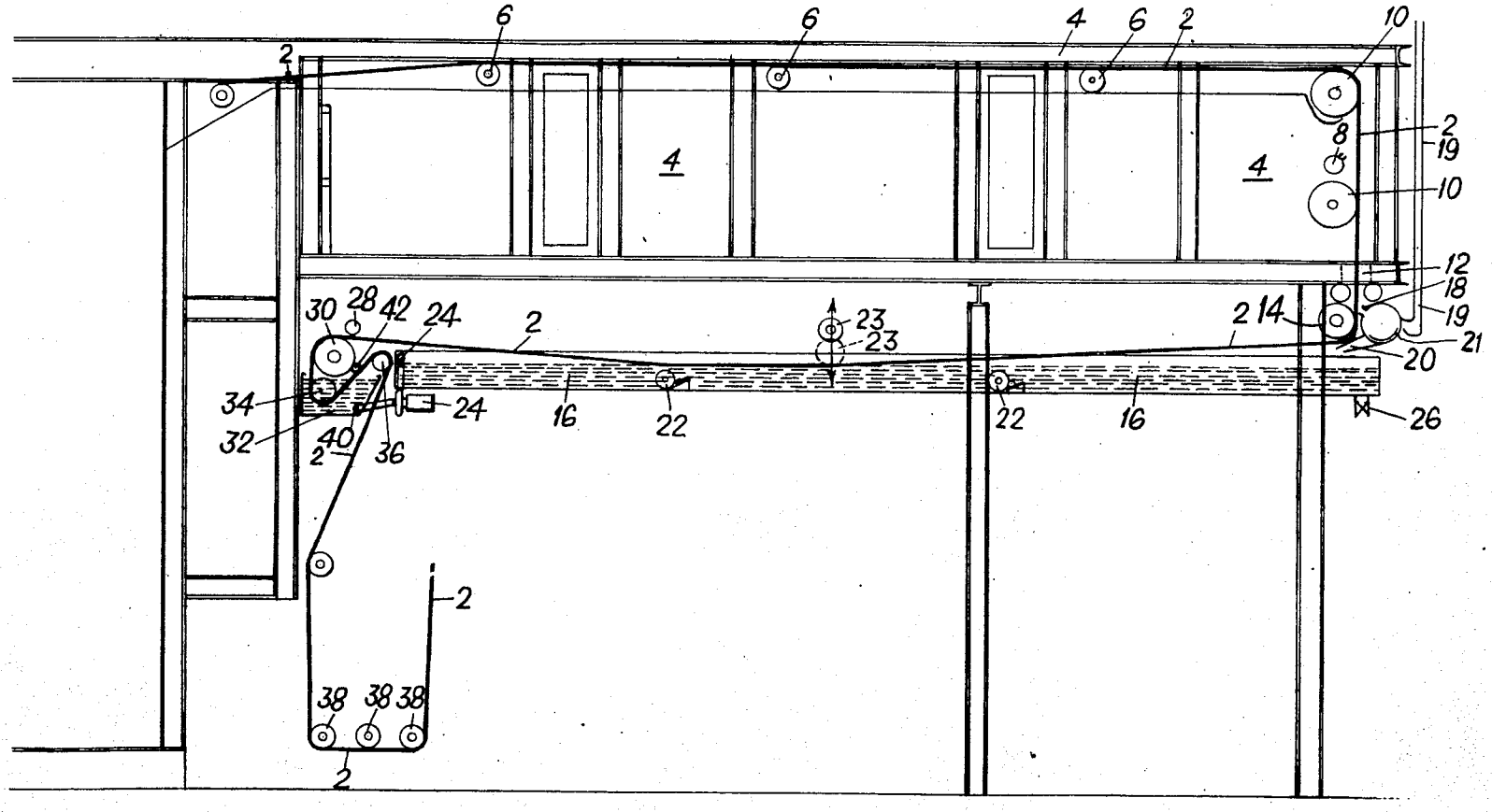
10
2
19
10
12
18
19
21
20
26
8
4
14
2
2
6
4
16
22
23
23
6
4
22
16
2
6
24
24
2
42
28
36
38
38
38
30
40
2
2
34
32

CARPET PRINTING APPARATUS

This invention relates to the printing of carpets and especially to carpets of acrylic material.

Problems arise when carpets of acrylic material are to be printed since if the pile face of the carpet contacts a roller at the temperature of the fibres within the steamer section of a carpet printing machine (in which the coloured dye is set), then the pile is given a "harsh feel." Equally, excess dye is spread onto the carpet giving serious dye smudging or "mark back." This latter effect is particularly pronounced if the carpet is fed face down around a roller to change the direction of movement of the carpet. Finally acrylic material tends to become plastic at temperatures above about 70°C and if it is cooled in the water bath section directly after emerging from the steamer section then the shock cooling leads to pile brittleness and deformation.

These problems are obviated or greatly reduced by a method of carpet printing in accordance with the invention in which the carpet is led from the steamer section on its back and is subjected to an air flow as it leaves the steamer and before it enters the washing section so as gradually to reduce the temperature of the pile.

In accordance with a further feature the carpet is conveyed face down after leaving the steamer section, on a bath of water which both brings the carpet back beneath the steamer section ready to enter the washer, without causing the pile to be fed unsupported over rollers and acts to wash excess dye from the face of the pile.

The invention also extends to carpet printing apparatus having an air nozzle located adjacent an outlet from the steamer section preferably arranged both to cool a carpet emerging through the outlet and to draw off a small amount of steam through the outlet to prevent ingress of air into the steamer at that point.

In accordance with a further feature of the invention the apparatus has an extended water bath located adjacent the steamer to act as a conveyor on which the carpet after leaving the steamer, can be floated before entering the normal washing section. The bath is preferably located beneath the steamer to convey the carpet back beneath the steamer.

After leaving the bath the carpet is preferably led around a roller having a part of its periphery immersed in a water tank through which water flows to remove excess dye left on the roller as the carpet passes therearound face down on its way from the water bath to the washing section of the machine.

The invention will now be further described by way of example with reference to the accompanying drawing which is a diagrammatic sectional elevation of a portion of a carpet printing machine adapted for carpets of acrylic fibres.

Referring to the drawing the carpet 2 enters an extension 4 of the standard steamer section of a carpet printing machine and passes on its back with the pile uppermost over support rollers 6. During its run through the steamer the coloured dyes are fixed by the steam injected into the steamer through an injector 8 but if the carpet pile is of an acrylic fibre, not all the dye is fixed at the end of the steamer run.

Consequently, if the carpet was to pass back through the steamer with its pile resting in contact with rollers at the bottom of the steamer, blurring and smudging of the coloured printed pattern would occur. Equally there would be a danger of pile deformation due to the fact that the temperature inside the steamer is above the temperature at which many acrylics become plastic. However, these problems are avoided by passing the carpet down over end rollers 10 out of the steamer through an opening 12 and back around an internally cooled roller 14 into a water bath 16 along which the carpet floats with its pile in contact with the water.

A steam suction member 18 sucks steam through the opening 12 and thus prevents air from entering the steamer and air is drawn by a nozzle 20 across the carpet pile between the opening 12 of the steamer and the point at which the carpet enters the water bath. The air and steam is then discharged to atmosphere through a duct 19, the quantity of air and steam being controlled by a movable damper 21 located within the air nozzle 20.

The air flow acts to reduce the temperature of the carpet gradually from say about 220°F inside the steamer to about 158°F before entry to the bath. This prevents shock cooling of the fibres of the carpet which could lead to brittleness, and reduces the temperature of the acrylic fibres below that at which they are plastic.

The water bath acts as a conveyor to carry the carpet back beneath the steamer and during this run excess colour is washed from the pile into the water bath. Rollers 22 immersed in the water provide support if the carpet sags unduly into the bath. A biased compensating roller 23 helps to maintain the carpet properly positioned in the bath.

Fresh water is delivered to the bath by a pump 24 at the outlet end and drained at 26 at the inlet end so that the flow of water is in a counter-direction to that of the carpet.

At the outlet from the bath the carpet passes beneath an adjustable cold water inlet 28 around a roller 30, into a water bath 32 and around guide rollers 34,36 before entry around rollers 38 to the standard washing section of the apparatus (not shown).

Due to the fact that the carpet is cooled and has had excess colour washed from its pile before it is tensioned with its face in contact with roller 30, no damage is done to the pile or the printed pattern even when the carpet is of acrylic material.

Water flows constantly into the bath 32 from the inlet 28 and is sucked out at 40 by the pump 24. A squeegee 42 such as that disclosed in our copending application Ser. No. 371,450, abandoned in favor of application Ser. No. 512,400, now U.S. Pat. No. 3,916,475, acts on the periphery of the roller 30 to remove excess colour from the roller.

The part of the printing apparatus shown in the drawing can be arranged to be in the form of an extension to a standard steamer section of a standard carpet printer. When nylon carpets are being printed the carpet can be passed back on its face on rollers (not shown) located above the bottom of the steamer extension.

It is envisaged that the apparatus of this invention may be used on all acrylics, modified acrylics and possibly polyester fibres as well as other fibres having the same or similar properties.

It is also envisaged that it may be desirable for there to be a temperature gradient in the water in the conveyor water bath 16, hotter adjacent the inlet to the bath from the steamer and cooler at the outlet adjacent the roller 30.

The direction of water flow in the tank will help to provide progressive cooling, as the water at the carpet input end of the tank will be at a higher temperature than at the carpet exit end due to transference of heat from carpet to water.

It may be necessary to provide a secondary air flow under very low pressure to bring down the temperature of the carpet if this is still too high after passing through the air suction zone and before making contact with the water in the bath.

We claim:

1. Apparatus for treating a printed carpet having a pile on one surface only comprising:

a steamer through which said carpet may be fed in a single, generally horizontal pass, means for feeding said carpet through said steamer with said one surface uppermost;

said steamer further having an outlet through which said carpet leaves the steamer, wherein there is further provided;

a liquid bath adjacent said steamer outlet and means for conveying said carpet generally horizontally across said bath including means for floating said carpet on said liquid with said one surface lowermost as said carpet is conveyed across said bath.

2. The apparatus of claim 1 which further includes an air nozzle means located between said steamer outlet and said bath for providing a flow of air over the pile of said carpet after it leaves said steamer and before it enters said bath.

3. The apparatus of claim 1 in which said bath has an inlet and an outlet, with said bath inlet adjacent said steamer outlet and said bath outlet adjacent said steamer inlet.

4. The apparatus of claim 1 in which said bath includes an outlet further including a roller around which said carpet passes, a portion of the periphery of said roller being immersed in a washing tank through which a liquid flows.

5. The apparatus of claim 1 in which said bath includes a liquid inlet, liquid outlet, carpet inlet and carpet outlet, with said liquid inlet being adjacent said carpet outlet and said liquid outlet adjacent said carpet inlet.

* * * * *